United States Patent [19]

Russell

[11] Patent Number: 4,519,592

[45] Date of Patent: May 28, 1985

[54] DEVICE FOR HOLDING FORMATION CORES FOR BORING

[75] Inventor: Gordon A. Russell, Dallas, Tex.

[73] Assignee: Mobil Oil Corporation, New York, N.Y.

[21] Appl. No.: 551,623

[22] Filed: Nov. 14, 1983

[51] Int. Cl.[3] ..... E21C 11/00

[52] U.S. Cl. ..... 269/25; 269/261; 269/274; 269/283; 269/902

[58] Field of Search ..... 269/20, 25, 26, 32, 269/258-264, 271-286, 902; 81/418, 424

[56] References Cited

U.S. PATENT DOCUMENTS

| | | | |
|---|---|---|---|
| 2,284,449 | 5/1942 | Rodess | 269/261 |
| 2,720,126 | 10/1955 | Bauer | 269/264 |
| 2,770,156 | 11/1956 | Brettrager | 269/283 |
| 2,796,787 | 6/1957 | Aske | 269/279 |
| 2,881,667 | 4/1959 | Ebert | 269/258 |
| 2,942,891 | 6/1960 | Zale | 269/20 |
| 3,811,668 | 5/1974 | Kotter | 269/258 |
| 4,096,608 | 6/1978 | Lagerstedt | 269/32 |
| 4,306,709 | 12/1981 | Hurn | 269/283 |

FOREIGN PATENT DOCUMENTS

| | | | |
|---|---|---|---|
| 284992 | 6/1915 | Fed. Rep. of Germany | 269/258 |
| 722447 | 1/1955 | United Kingdom | 269/261 |

*Primary Examiner*—Robert C. Watson

*Attorney, Agent, or Firm*—Alexander J. McKillop; Michael G. Gilman; Charles J. Speciale

[57] ABSTRACT

Disclosed is a fluid actuated core sample holding device for use with a boring drill press, the holding device having rotatable vise jaws and flat support surfaces adjacent the respective jaws and containing removable holding pins. The rotatable jaws permit a greater versatility in the positioning of core samples held between them relative to the drill press, while the flat support surfaces and associated holding pins serve to hold flat or irregularly shaped core samples, not easily held by the jaws, for boring.

14 Claims, 5 Drawing Figures

FIG. 5
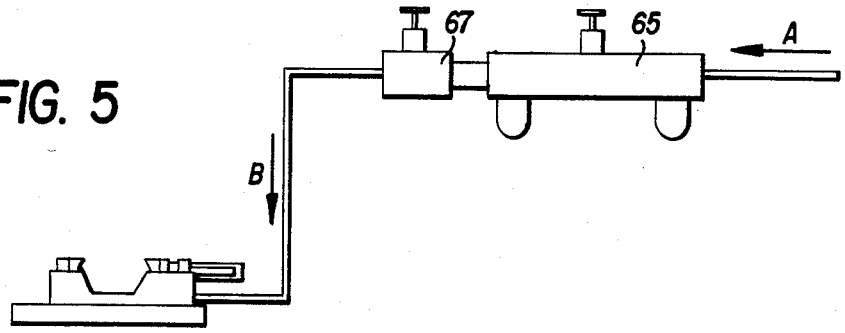
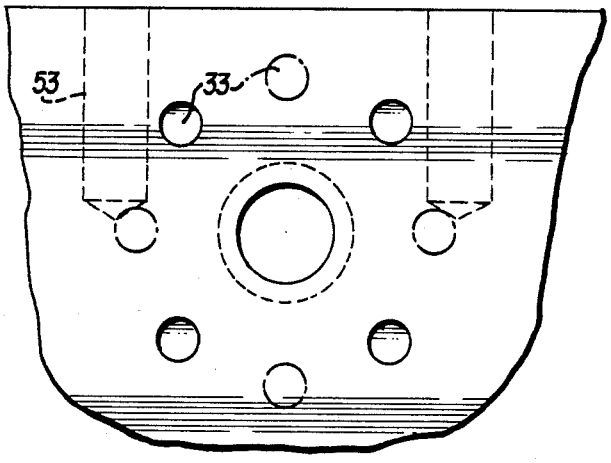
FIG. 4

DEVICE FOR HOLDING FORMATION CORES FOR BORING

BACKGROUND OF THE INVENTION

1. Field of the Invention

The present invention relates to a device for holding borehole formation cores under a drill press which bores the cores to produce core samples for fluid flow testing.

2. Discussion of the Prior Art

It is common in the hydrocarbon exploration and production field to take a formation core sample from a borehole and analyze it for various subsurface formation properties and to produce data which is useful for hydrocarbon drilling and/or recovery operations. In a typical case, a larger formation core sample, e.g., 6" in diameter and 9–12" long, is taken in the field and sent to a laboratory for analysis. Because of the different experiments which may be performed on the core sample, it is also common to produce a number of smaller core samples for testing from the larger core sample. To do this, the larger core sample is typically bored at a plurality of locations to produce a plurality of core samples.

A vise-type holding device having jaws, at least one of which is movable, is generally used to hold the larger core sample under a drill press during boring. Although the jaws can reciprocally move relative to one another, they are otherwise limited in their freedom of movement, making it difficult to properly hold the larger core sample in different positions for boring. In addition, it is often difficult to hold large irregularly shaped or flat core samples between the jaws. If the core sample is not properly secured during boring, damage to the core sample may result. Finally, the jaws are typically reciprocally moved by a hand-operated mechanical screw mechanism which is slow and cumbersome to operate and which makes it difficult to precisely control the pressure applied to the core sample. Too much pressure may cause the sample to crack or break, while too little pressure could cause the sample to slip and be damaged during a boring operation.

SUMMARY OF THE INVENTION

The present invention was devised to overcome the foregoing problems with conventional core sample holding devices.

Accordingly, one object of the invention is the provision of a formation core sample holding device which is easily adapted to handle and securely hold differently sized and shaped core samples.

Another object of the invention is the provision of a formation core holding device having jaws which not only reciprocate towards and away from each other, but which are also rotatable about their center axes to permit greater flexibility in the positioning of the jaws for sample holding.

Another object of the invention is the provision of a formation core holding device which employs, in addition to sample holding jaws, additional core holding portions adjacent the jaws which are movable in reciprocation with the jaws, the additional core holding portions having removable pins which are selectively used at the holding portions for holding flat and irregularly shaped core samples.

Another object of the invention is the provision of a formation core sample holding device in which the speed of reciprocation of the jaws and holding portions, as well as the holding pressure applied to a held core sample, can be readily and easily controlled.

These and other objects, advantages and features of the invention will become more apparent from the following detailed description of the invention which is provided in connection with the following drawings.

BRIEF DESCRIPTION OF THE DRAWINGS

FIG. 4 is a sectional view along the line 4—4 in FIG. 3; and

FIG. 5 is a schematic representation of the operating fluid control system used with the FIG. 1 embodiment.

DETAILED DESCRIPTION OF THE INVENTION

Figure 1:
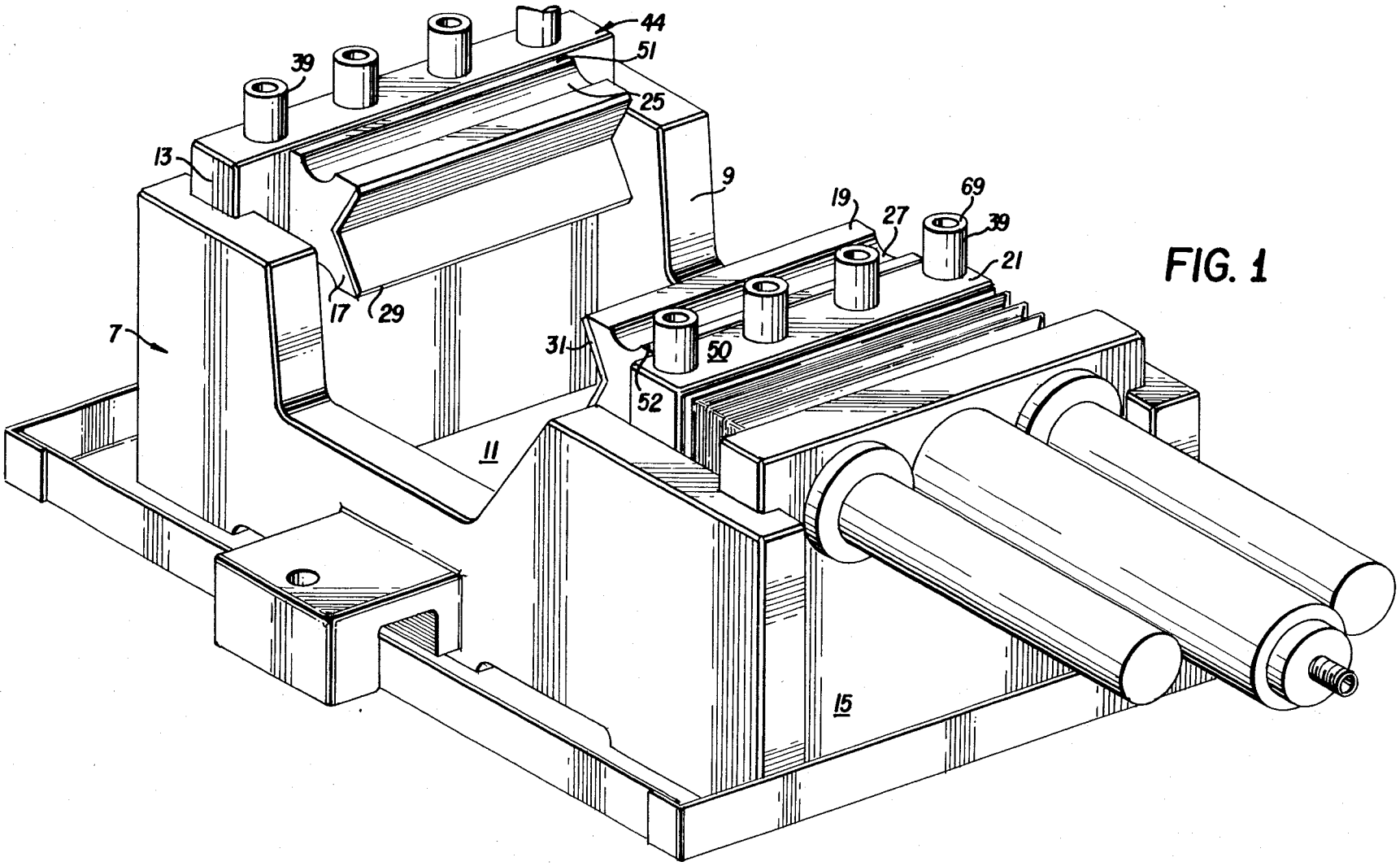
FIG. 1 is a perspective view of an embodiment of a core sample holding device of the invention.
Figure 2:
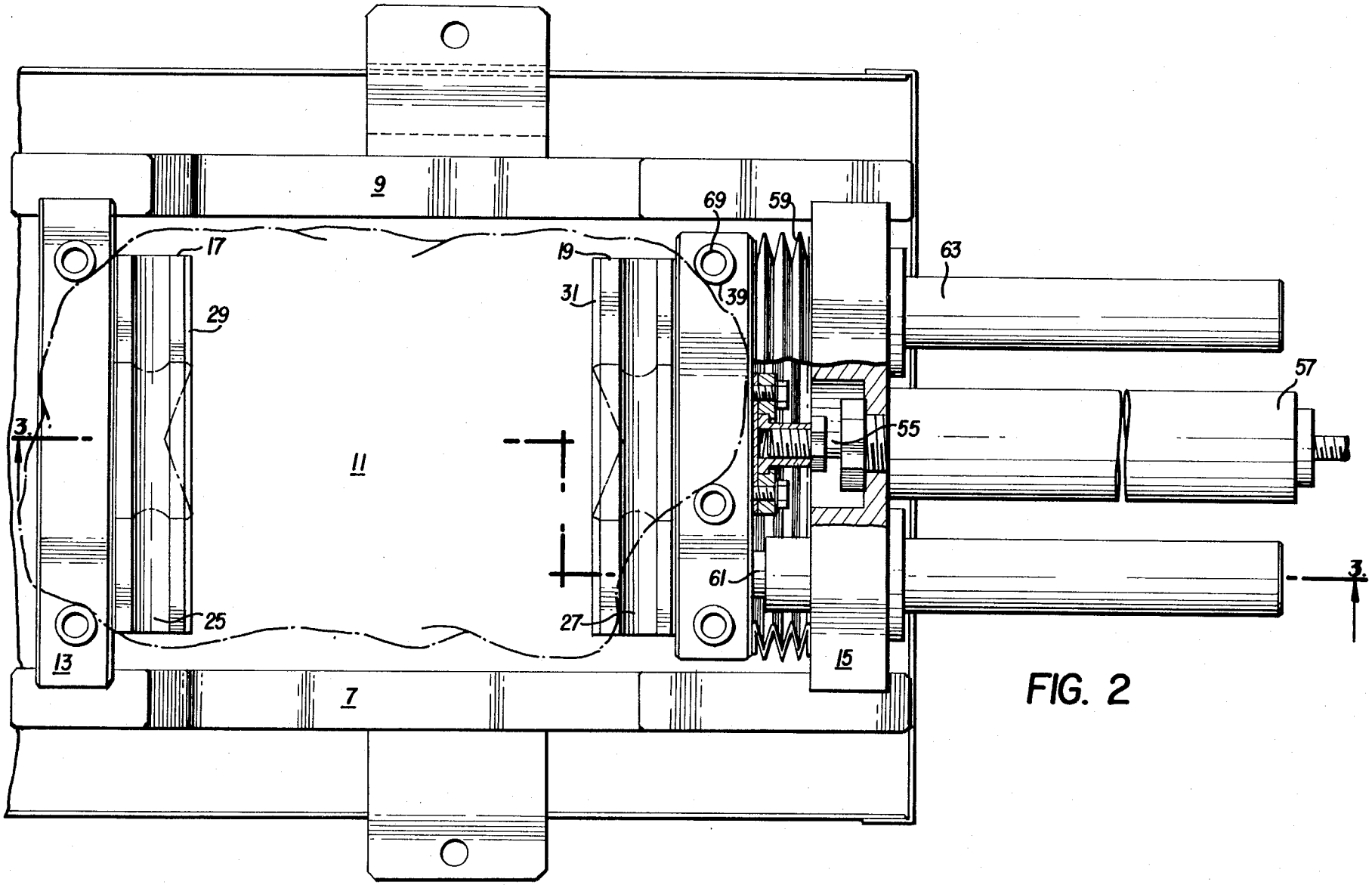
FIG. 2 is a plan view thereof.
Figure 3:
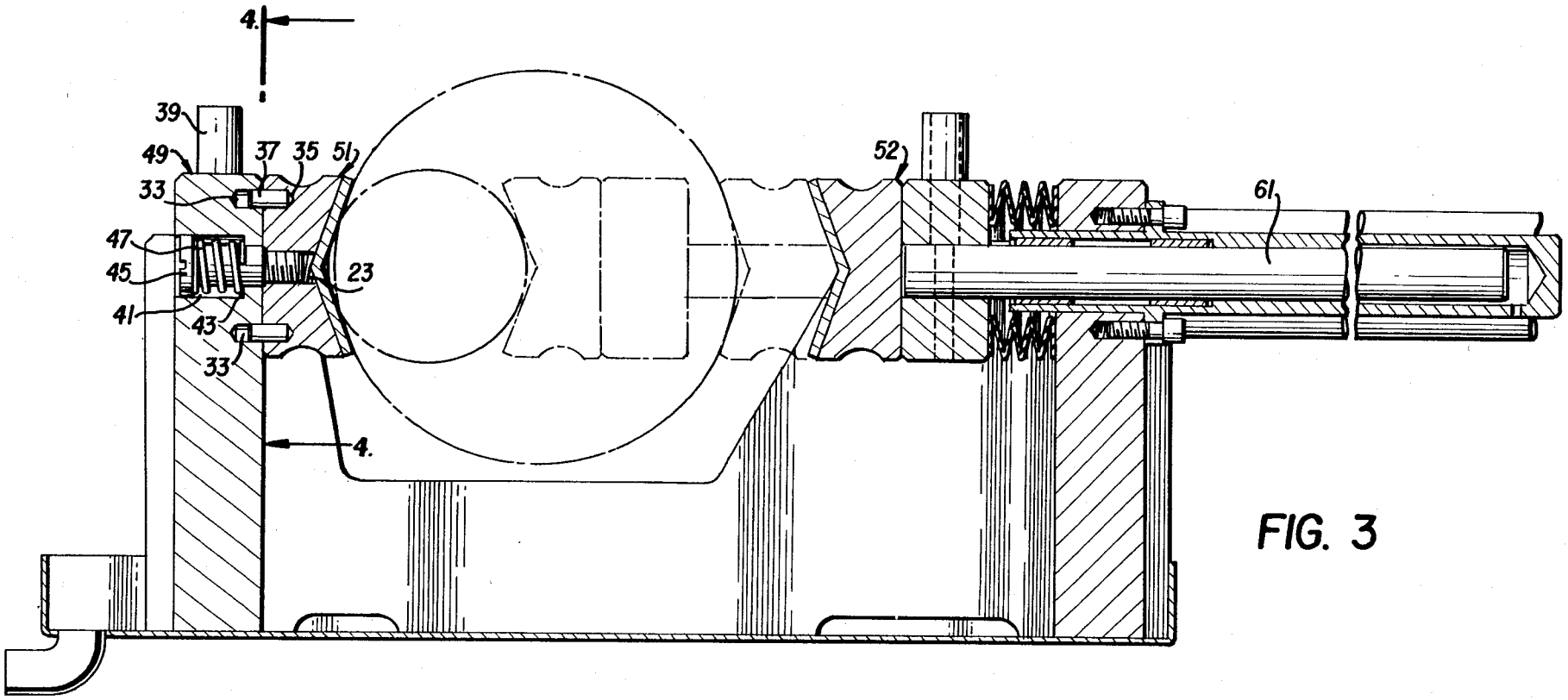
FIG. 3 is a sectional view thereof along the line 3—3 in FIG. 2.

FIGS. 1–3 illustrate in perspective, plan and side sectional views respectively, a preferred embodiment of a device for holding formation cores constructed in accordance with the teachings of the invention.

The device includes a base 11 which supports a pair of parallel and spaced fixed supports 13 and 15, which are interconnected by stationary side frames 7 and 9 to form a generally rectangular structure when viewed from above (FIG. 1). The fixed support 13, which extends upright, supports near its upper end a vise jaw 17, while fixed support 15 supports near its upper end an assembly for moving and guiding a movable support 21, which in turn supports a movable vise jaw 19. The fixed support 13 and movable support 21 and associated vise jaws 17,19 are arranged such that the vise jaws 17 and 19 oppose one another to hold between them a core sample.

The movable support 21 is connected to one end of a piston rod 55 of a fluid actuated cylinder 57. Accordingly, to and fro actuation of cylinder 57 causes reciprocal motion of support 21 and in turn vise jaw 19 towards and away from opposing vise jaw 17.

Each of the vise jaws 17 and 19 includes a V-shaped holding face containing thereon a cushioning Neoprene layer (29 for jaw 17 and 31 for jaw 19). In addition, each vise jaw 17,19 has a generally rectangular peripheral shape, as best shown in FIG. 1. FIGS. 2 and 3 illustrate by solid line the vise jaws 17,19 in a position where the longer side of the rectangular shape extends longitudinally along the fixed supports 13 and 15.

Each of the vise jaws 17 and 19 is mounted to its respective support 13 and 21 by means permitting rotation of the vise jaws 17 and 19 relative to the respective supports about a pivot axis which extends in the direction of reciprocal movement of jaw 19 so that the vise jaws may be rotated to different positions. For example, the vise jaws 17,19 may be rotated to where the long sides of the rectangular jaws are oriented vertically instead of horizontally, as shown by dotted lines in FIG. 2, or at some other angle between the vertical and horizontal positions. This pivoting movement of the vise jaws 17,19 will be described with specific reference to structures associated with vise jaw 17; however, it should be appreciated that similar associated pivot permitting structures are also provided at vise jaw 19 and movable support 21.

Rotating movement of vise jaw 17 occurs about a pivot axis which is defined by the axis of a threaded bore 23, which is connected to the threaded end of a bolt 45. Bolt 45 is countersunk within a bore 41 provided in fixed support 13. Bore 41 includes a shoulder 43. Between the shoulder 43 and the head of the threaded bolt 45 is provided a biasing spring 47. Spring 47 operates to push the head of the threaded bolt in a direction away from the shoulder 43, thus effectively biasing vise jaw 17 into engagement with a side face of the fixed support 13. With this arrangement, the vise jaw 17 can be pulled away from fixed support 13 and against the biasing of spring 47 and rotated to a different position about the pivot axis.

A holding mechanism is provided between the fixed support 13 and vise jaw 17 to hold the vise jaw 17 in one of a plurality of positions which it can assume upon rotation about its pivot axis. The holding mechanism is formed by positioning bores 33 provided in the fixed support 13 at positions spaced radially from the pivot axis of the vise jaw 17 and spaced annularly therearound. The positioning bores 33 cooperate with one or more projections 37 which extend from the face of vise jaw 17 which is in engagement with the side face of fixed support 13. The positioning pins are press fitted into pin holding bores 35 provided in the back side of vise jaw 17 (the side opposite the core engaging face of jaw 17). Accordingly, when the vise jaw 17 is pulled against the biasing of spring 47, the positioning pins 37 disengage from the positioning bores 33, allowing the vise jaw 17 to rotate about its pivot axis. Once a selected rotatable position is achieved, the positioning pins 37 are again aligned with corresponding positioning bores 33 in the fixed support and the vise jaw 17 is allowed to be pulled by the return force of spring 47 into face-to-face engagement with fixed support 13. The positioning pins which are now projecting into predetermined positioning bores 33 securely hold the vise jaw 17 in the position to which it was rotated. The positioning bores 33 can be located so that the vise jaw 17 may only rotate between a horizontal (FIG. 1) and vertical (dotted lines, FIG. 2) position, or additional positioning bores (FIG. 4) can be provided spaced annularly about the pivot axis of vise jaw 17 so that it can be rotated to one of a plurality of different positions.

To facilitate operator gripping of the vise jaw 17 during the manual pulling and rotation, grasping notches in the form of half-moon grooves 25 are provided on the longer side edges of the rectangular shaped vise jaw 17. Similar notches 27 are provided on vise jaw 19.

The upper surfaces of fixed support 13 and movable support 21 are formed as respective flat surfaces 49,50. These flat surfaces are designed to hold, together with removable holding pins 39, flat and irregularly shaped cores which cannot be easily and securely held between vise jaws 17 and 19. Each of the flat surfaces 49 and 50 have countersunk bores 53 (FIG. 4) which receive an extension shaft of the removable holding pins 39. The holding pins may be placed in one or more of the bores 53 as necessary in order to hold irregularly shaped or flat core samples. Both holding pins 39 as well as the flat surfaces 49,50 thus provide an additional and alternative way of holding core samples. Moreover, when the vise jaws 17 and 19 are positioned horizontally, as shown by solid lines in FIGS. 2 and 3, the uppermost peripheral sides 51,52 thereof reside in the same plane as the respective associated flat surfaces 49 and 50. Thus, the sides of the vise jaws 17 and 19 act as flat extensions to the flat surfaces 49 and 50, providing additional horizontal support for a core held between the holding pins 39 provided on the fixed support 13 and movable support 21. The holding pins 39 are also covered with a Neoprene layer 69 to protect the core samples from damage while being held.

The movable support 21 and associated movable vise jaw 19 are reciprocally moved by means of the fluid actuated cylinder 57 discussed above. The piston rod 55 of the cylinder engages with the movable support 21 and pushes or pulls it in its path of travel. Additional guide rod assemblies 61,63 are provided on each lateral side of the piston rod 55 to smoothly guide the movable support 21 in its path of travel. Both the piston rod 55 as well as the guide rod for guide rod assemblies 61,63 are contained within a bellows housing 59, which protects them from local environmental conditions such as dust, moisture, debris, etc. Representative positions to which vise jaws 19 can be moved, as well as representative core samples held by vise jaws 17 and 19, are illustrated in dotted lines in FIG. 3. FIG. 2 illustrates in dot and chain lines a representative flat core held by certain ones of removable pins 39 on flat surfaces 49,50.

The fluid control system for actuating fluid actuated cylinder 57 is illustrated in FIG. 5. For the purpose of simplifying description, it will be assumed that air pressure is used as the fluid medium to actuate cylinder 57; however, hydraulic or other fluids can also be used.

As shown in FIG. 5 by the incoming arrow A, pressurized air enters into a pressure regulator 65, from which it enters a flow control valve 67. The output of the flow control valve 67, shown by arrow B, is applied to the control ports of fluid actuated cylinder 57 through a switching valve (not shown). With this arrangement, the pressure regulator can be set to a predetermined pressure which is exerted by the vise jaws 17 and 19 or holding pins 39 respectively provided at the supports 13 and 21 on a held core sample. In addition, the flow control valve 67 permits regulation of the speed or rate at which the vise jaw 19 and associated movable support 21 move toward and away from vise jaw 17 and fixed support 13. The switching air control valve is used to control whether the fluid applied to cylinder 57 is used to push the piston rod 55 out or to retract it.

As should be apparent from the foregoing discussion, the holding device of the invention has great versatility in use, since the vise jaws 17 and 19 can be rotated to different positions to best accommodate a core sample held between them. In addition, the side surfaces of the vise jaws 17 and 19 cooperate with flat surfaces 49 and 50 provided at the respective fixed support 13 and movable support 21 to support flat or other irregularly shaped cores which may be positioned on top of these surfaces and held by removable holding pins 39 respectively provided in the bores 53 at the fixed support 13 and movable support 21. By making holding pins 39 removable, different sized and shaped core samples can be easily accommodated and held between the holding pins 39. Moreover, both the speed with which the vise jaws are made to approach one another and the applied pressure on the core sample held by the vise jaws (or holding pins 39) is easily and carefully regulated by both a flow control and pressure regulating system.

While a preferred embodiment of the invention has been described and illustrated above, many modifications can be made thereto without departing from the spirit and scope of the invention. For example, although only one fluid actuated cylinder has been shown to move one of the vise jaws 19, a similar arrangement can be provided to move the other vise jaw 17 so that both vise jaws are reciprocally movable. Other variations will also readily occur to those skilled in the art. Accordingly, the invention is not to be considered as limited by the foregoing description, but is only limited by the scope of the claims appended hereto.

I claim:

1. A device for holding objects for boring comprising:

a first vise jaw having an object holding face;

a second vise jaw having an object holding face;

first means for supporting said first vise jaw so that it is rotatable about a pivot axis thereof passing through its object holding face;

second means for supporting said second vise jaw so that it is rotatable about a pivot axis thereof passing through its object holding face;

means for respectively holding said first and second jaws in predetermined rotatable positions thereof;

said first and second supporting means each comprising a vise jaw support element, and said holding means comprises, for each vise jaw, at least one projection arranged radially of a respective vise jaw rotation axis and on one of said support element and its associated vise jaw and a plurality of bores arranged annularly and radially of said rotation axis and provided at the other of said support element and associated vise jaw, said bores engaging with said projection at different rotatable positions of said associated vise jaw to hold it at said predetermined rotatable positions, and means for respectively biasing each of said vise jaws to its respective support element, each said vise jaw being manually separable from a respective support element against said biasing means to disengage an associated projection from said bores and permit rotation of the vise jaw about its respective pivot axis; and means for reciprocally moving at least one of said first and second supporting means to adjust the relative distance between said first and second vise jaws.

2. A device as in claim 1, wherein said vise jaws are each held to their respective support elements by a bolt fitted in a bore in said support elements which is connected with a respective vise jaw and which defines said pivot axis, said biasing means being a spring acting between a head of said bolt and a shoulder of said bore.

3. A device as in claim 1, further comprising a plurality of annularly arranged projections radially spaced from said pivot axis for engaging with said bores.

4. A device as in claim 1, further comprising grasping notches provided on side peripheral surfaces of said vise jaws for facilitating rotary adjustments thereof.

5. A device as in claim 1, wherein the object holding faces of said jaws are covered with a layer of Neoprene.

6. A device as in claim 1, wherein said object holding faces have a V-shape.

7. A device as in claim 1, wherein said first and second supporting means each comprise an upstanding support element having a flat upper surface which extends in a direction perpendicular to the reciprocal movement direction of said at least one supporting means, a plurality of bores provided in said upper surface and spaced therealong, and a plurality of removable pins positioned in said bores and extending upwardly from said flat surfaces, said pins serving with said flat surfaces as object holding surfaces.

8. A device as in claim 7, wherein portions of said pins extending upwardly from respective flat surfaces are covered with Neoprene.

9. A device as in claim 7, wherein said vise jaws are rectangular in shape and have planar side edge portions, and the flat upper surface of a respective support element resides in a common plane with a planar side edge portion of a respective jaw connected thereto.

10. A device as in claim 1, wherein said reciprocally moving means comprises a fluid actuated cylinder for reciprocally moving at least one of said supporting means, and said device further comprises means for controlling the pressure of the fluid applied to said cylinder to thereby control the pressure exerted on an object held by said holding faces.

11. A device as in claim 10, further comprising means for controlling the rate at which said fluid is applied to said cylinder to thereby control the rate of movement of said supporting means.

12. A device as in claim 7, wherein said reciprocally moving means comprises a fluid actuated cylinder for reciprocally moving at least one of said supporting means, and said device further comprises means for controlling the pressure of the fluid applied to said cylinder to thereby control the pressure exerted on a held object by said holding faces.

13. A device as in claim 12, further comprising means for controlling the rate at which said fluid is applied to said cylinder to thereby control the rate of movement of said supporting means.

14. A device as in claim 1, wherein said first and second vise jaws are rectangular in shape and said jaws are rotatable to at least two positions where the longer sides of said rectangular shape are disposed horizontally and vertically respectively.

* * * * *